US005785492A

United States Patent [19]

Belsom et al.

[11] Patent Number: 5,785,492

[45] Date of Patent: Jul. 28, 1998

[54] METHOD AND APPARATUS FOR SEALING A GAS TURBINE STATOR VANE ASSEMBLY

[75] Inventors: Keith C. Belsom, Stuart, Fla.; M. Stefan Maier, Cape Neddick, Me.

[73] Assignee: United Technologies Corporation, Hartford, Conn.

[21] Appl. No.: 822,895

[22] Filed: Mar. 24, 1997

[51] Int. Cl.[6] ..... F04D 29/18

[52] U.S. Cl. ..... 415/173.7; 415/173.1; 415/173.4

[58] Field of Search ..... 415/115, 116, 415/170.1, 209.1, 209.2, 209.3, 173.7, 174.1, 173.1–173.4

[56] References Cited

U.S. PATENT DOCUMENTS

| | | | |
|---|---|---|---|
| 3,365,125 | 1/1968 | Gaubatz | 415/115 |
| 4,464,580 | 8/1984 | Miller et al. | 415/174.2 |
| 5,423,659 | 6/1995 | Thompon | 415/173.1 |
| 5,429,478 | 7/1995 | Krizan et al. | 415/115 |
| 5,480,162 | 1/1996 | Beeman, Jr. | 415/174.2 |
| 5,584,652 | 12/1996 | Shaffer et al. | 415/115 |

*Primary Examiner*—John T. Kwon
*Attorney, Agent, or Firm*—Richard D. Getz

[57] ABSTRACT

A stator vane assembly for a gas turbine engine is provided which includes a plurality of stator vane segments and a seal ring. Each stator vane segment has an outer platform, an inner platform, and an airfoil extending between the platforms. The stator vane segments collectively form an annular structure. The seal ring includes an abradable bearing pad which extends out from an axial surface of the body of the seal ring. The seal ring is attached to a non-rotating member within the engine, positioned in close proximity to the stator vane segments. Contact, and consequent friction, between the individual stator vane segments and the abradable bearing pad causes the abradable bearing pad to abrade, thereby creating a sealing surface reflective of the opposing stator vane segments in contact with the abradable bearing pad.

10 Claims, 3 Drawing Sheets

METHOD AND APPARATUS FOR SEALING A GAS TURBINE STATOR VANE ASSEMBLY

The invention was made under a U.S. Government contract and the Government has rights herein.

BACKGROUND OF THE INVENTION

1. Technical Field

This invention applies to gas turbine engines in general, and to stator vane assemblies within gas turbine engines in particular.

2. Background Information

The fan, compressor, and turbine sections of a gas turbine engine typically include a plurality of rotor assemblies and stator assemblies. The rotor assemblies have a plurality of blades attached to a disk for rotation around a rotational axis. The stator assemblies include a plurality of vane segments arranged in an annular structure, centered on the rotational axis and disposed radially between an inner support ring and either an outer case or outer support ring. The rotor assemblies impart work to the core gas flow within the compressor and extract work from the core gas flow within the turbine. The stator assemblies improve efficiency by guiding the core gas flow into, or out of, the rotor assemblies.

The work added to the core gas flow in the compressor and energy added in the combustors generates sufficient thermal energy in the core gas flow to necessitate cooling within the core gas flow path. Cooling is accomplished by passing cooling air through holes in the vanes, walls, and/or blades within or adjacent to the core gas flow path. The pressure of the cooling air, higher than that of the core gas flow, forces the cooling air through the cooling holes. A person of skill in the art will recognize, however, that the pressure also forces the cooling air through undesirable leak paths, thereby using more cooling air than is necessary for cooling purposes.

The leak paths created between the stator vane segments and an adjacent static member (e.g., an inner vane support, an inner seal hoop, the outer case, or an outer vane support) provide some of the most challenging sealing problems within a stator vane assembly. Brush seals and "butt end" seals are two types of seals presently used to minimize leakage between stator vane segments and an adjacent static member. Brush seals accommodate relative movement between the stator vane segments and the static member and therefore provide an effective seal, but are prohibitively expensive. Presently available butt end seals, on the other hand, seal by creating a tortuous leak path that impedes leakage. Presently available butt end seals are less expensive than brush seals, but do not seal as well nor accommodate as much relative motion. A disadvantage of presently available butt seals is that misalignment between adjacent stator vane segments under load cannot be adequately accommodated. Specifically, core gas flow typically loads the stator vane segments in a non uniform manner thereby causing the individual segments to skew and create gaps between the butt end seal and that particular stator vane segment.

In addition, presently available butt end seals cannot account for manufacturing tolerance differences present in stator vane segments. The axial length of the outer platform of each vane segment, for example, is machined to a dimension within a given tolerance range. In most cases, the assembly of the vane segment annular structure will have vane segment outer platforms with different axial lengths due to tolerancing. Hence, the magnitude of the gap between the butt end seal and the axial face of the outer platforms will vary by an amount directly related to the differences in outer platform axial length. In a worst case scenario, a few of the stator vane segments will have outer platforms with a maximum axial length (i.e., the maximum dimension allowable within the tolerance range) and the remainder of the stator vane segments will have outer platforms with a minimum axial length (i.e., the minimum dimension allowable within the tolerance range). The gap between the minimum length vane segments will provide too great a leakage path and the maximum platform axial length stator vanes will contact the butt end seal and prevent the butt end seal from closing the gap.

Hence, what is needed is a stator vane assembly having improved means for sealing between the stator vane segments and a static member within the gas turbine engine.

DISCLOSURE OF THE INVENTION

It is, therefore, an object of the present invention to provide a stator vane assembly for a gas turbine engine that improves performance of the engine by minimizing cooling air leakage.

It is another object of the present invention to provide a stator vane assembly having apparatus for sealing that accommodates movement of stator vane segments.

It is another object of the present invention to provide a stator vane assembly having apparatus for sealing that accommodates machining tolerances in stator vane segments.

It is another object of the present invention to provide a less expensive apparatus for sealing within a stator vane assembly.

According to the present invention, a stator vane assembly for a gas turbine engine is provided which includes a plurality of stator vane segments and a seal ring. Each stator vane segment has an outer platform, an inner platform, and an airfoil extending between the platforms. The stator vane segments collectively form an annular structure. The seal ring includes an abradable bearing pad which extends out from an axial surface of the body of the seal ring. The seal ring is attached to a non-rotating member within the engine, positioned in close proximity to the stator vane segments. The abradable bearing pad extends out from the body of the seal ring in the direction of the stator vane segments. Contact, and consequent friction, between the individual stator vane segments and the abradable bearing pad causes the abradable bearing pad to abrade, thereby creating a sealing surface reflective of the opposing stator vane segments in contact with the abradable bearing pad.

An advantage of the present invention is that the stator vane assembly improves performance of the engine by minimizing cooling air leakage. Specifically, stator vane segment movement abrades a custom sealing surface within the abradable bearing pad. For example, if core gas flow loading skews the stator vane segments, the abradable bearing pad will abrade to reflect the skew and thereby minimize the clearance gap between the seal ring and the stator vane segments.

Another advantage of the present invention is that the apparatus for sealing accommodates machining tolerances in stator vane segments. Specifically, the abradable bearing pad of the present invention accommodates dimensional variations in the stator vane segment surfaces contacting the seal ring, and thereby minimizes any leak paths that may exist between the seal ring and the stator vane segments.

Another advantage of the present invention is that a less expensive apparatus for sealing within a stator vane assembly is provided.

These and other objects, features, and advantages of the present invention will become apparent in light of the detailed description of the best mode embodiment thereof, as illustrated in the accompanying drawings.

BEST MODE FOR CARRYING OUT THE INVENTION

Figure 1:
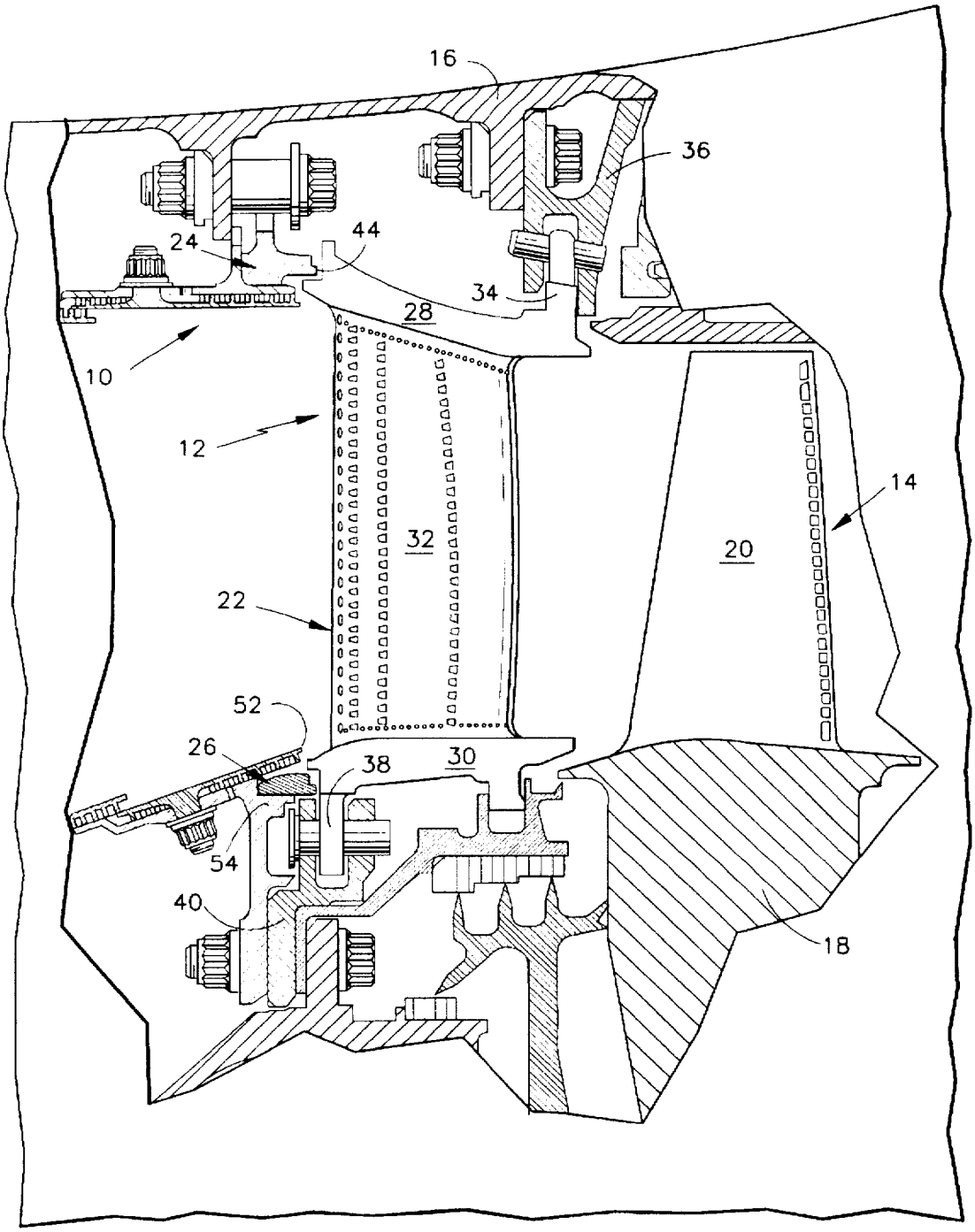
FIG. 1 is a diagrammatic view of a turbine inlet guide vane downstream of a combustor and upstream of a first stage turbine rotor.

Referring to FIG. 1, a gas turbine engine includes a combustor 10, a turbine inlet guide vane assembly 12, and a first stage rotor 14 disposed radially inside of an outer case 16. The first stage rotor 14 includes a disk 18 rotatable around an axis and a plurality of rotor blades 20 distributed around the circumference of the disk 18. The turbine inlet guide vane assembly 12 includes a plurality of stator vane segments 22, an outer seal ring 24, and an inner seal ring 26. Each stator vane segment 22 includes an outer platform 28, an inner platform 30, and at least one airfoil 32 extending between the platforms 28,30. The stator vane segments 22 collectively form an annular structure. The outer platform 28 of each stator vane segment 22 includes an outer mounting flange 34. The outer mounting flange 34 is received within an outer support ring 36, which in turn is fixed to the outer case 16. The inner platform 30 of each stator vane segment 22 includes an inner mounting flange 38. The inner mounting flange 38 is attached to an inner support ring 40, centered on the rotational axis of the engine.

Figure 2:
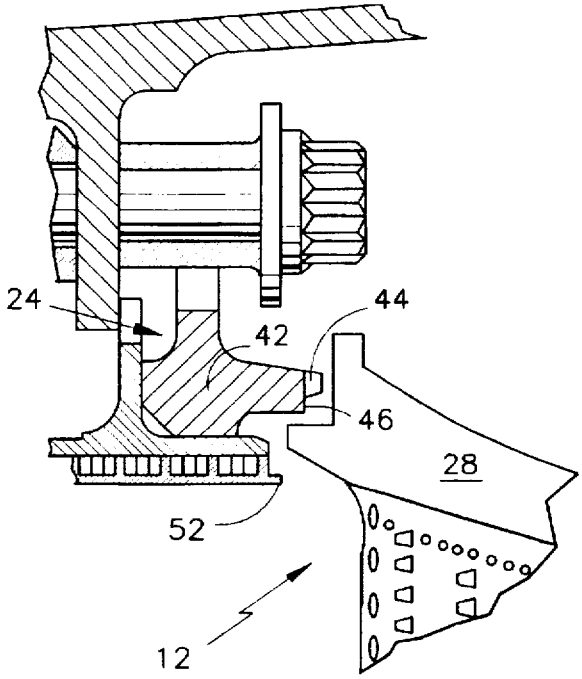
FIG. 2 is an enlarged partial view of a first embodiment of the present invention stator vane assembly shown in FIG. 1.
Figure 4:
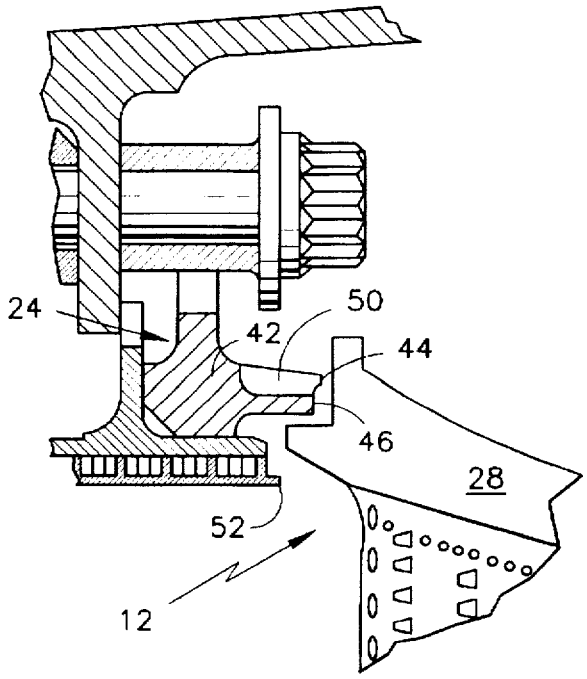
FIG. 4 is an enlarged partial view of a third embodiment of the present invention stator vane assembly shown in FIG. 1.
Figure 3:
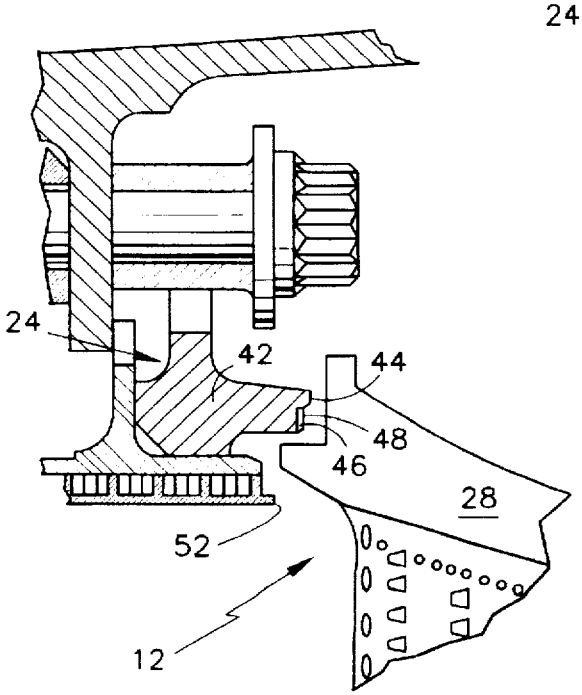
FIG. 3 is an enlarged partial view of a second embodiment of the present invention stator vane assembly shown in FIG. 1.

Referring to FIGS. 2–4, the inner 26 and outer 24 seal rings each include a body 42 and an abradable bearing pad 44 extending out from an axial surface 46 of the body 42. For sake of explanation, FIGS. 2–4 show an enlarged view of the outer seal ring 24. The abradable bearing pad 44 comprises a material having a hardness less than that of the member which will contact the pad 44. The hardness range of the abradable bearing pad 44 will depend upon the application, but in all cases the pad 44 will be "soft" enough to prevent undesirable wear on the member contacting the pad 44. In a first embodiment (FIG. 2), the abradable bearing pad 44 is bonded to the axial surface 46 of the body 42. In a second embodiment (FIG. 3), the abradable bearing pad 44 is integrally formed within the axial surface 46 of the body 42. In this embodiment, the axial surface 46 of the body 42 further includes a stop 48, having a hardness substantially greater than that of seal ring body 42, bonded to a portion of the axial surface 46, axially inside of the abradable bearing pad 44. Significant abrading of the pad 44 will cause the pad 44 and stop 48 to become substantially coplanar, at which point the member contacts the stop 48 and is precluded from further abrading the axial surface 46 of the seal ring 24, 26. In a third embodiment (FIG. 4), the abradable bearing pad 44 is a detachable and replaceable ring 50 mounted on the body 42, which extends out from the axial surface 46 of the body 42. Acceptable methods of mounting the abradable ring 50 on the body 42 include a press-type fit, mechanical fastener, brazing, and others.

In the application shown in FIGS. 1–4, the outer seal ring 24 is mounted on the aft end 52 of the combustor 10, in close proximity to the outer platforms 28 of the stator vane segments 22 of the turbine inlet guide vane assembly 12. The inner seal ring 26 is mounted on a combustor support ring 54 positioned radially inside of the combustor 10, adjacent the inner platforms 30 of the stator vane segments 22. Like the turbine inlet guide vane assembly 12, neither the combustor 10 nor the combustor support ring 54 rotates. Clearance gaps may be provided between the seal rings 24, 26 and the inner 30 and outer 28 platforms to accommodate tolerance build-up, thermal growth, or the like.

Figure 5:
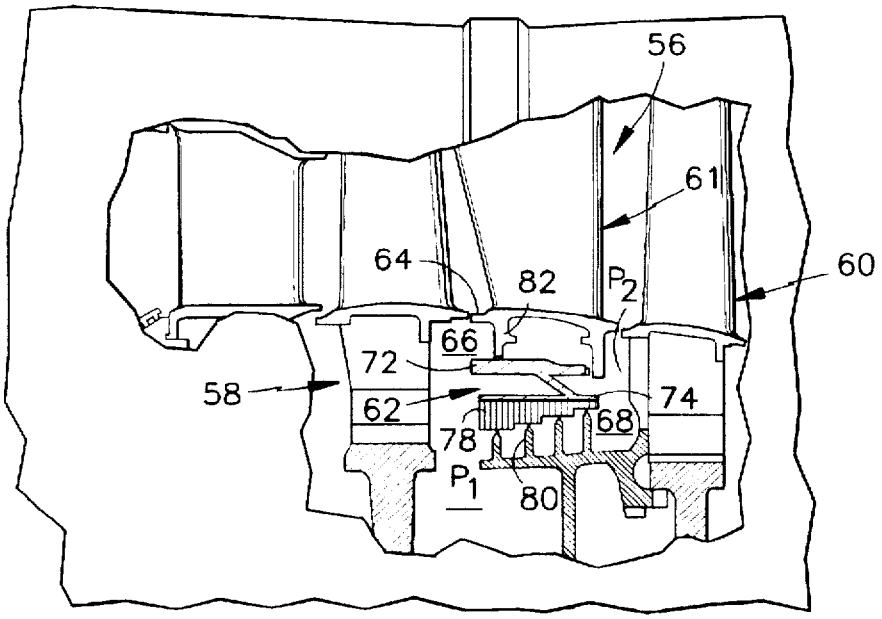
FIG. 5 is a diagrammatic view of a second stage turbine stator vane assembly disposed aft of a first stage turbine rotor and forward of a second stage turbine rotor.
Figure 6:
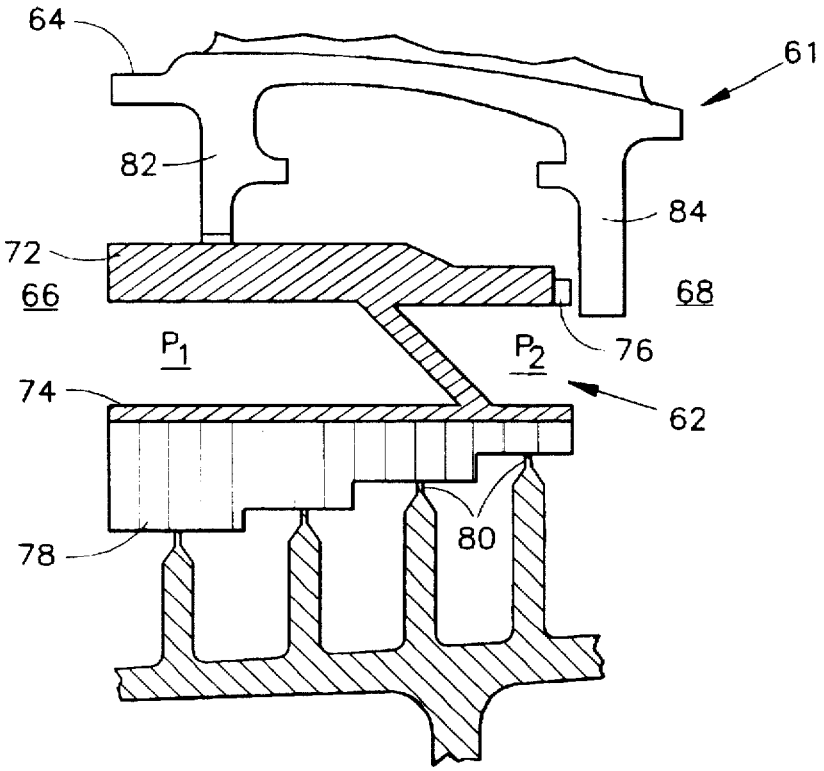
FIG. 6 is an enlarged partial view of the seal ring shown in FIG. 5

Referring to FIGS. 5 and 6, an alternative embodiment of the present invention is shown employed within a second stage turbine stator vane assembly 56, disposed between first 58 and second 60 stage rotors. The stator vane assembly 56 includes a plurality of stator vane segments 61 similar to those described heretofore, collectively forming an annular structure. A seal ring 62, located radially inside of the inner platforms 64 of the stator vane segments 61, is used to maintain a pressure difference between a first annular region 66 adjacent the first stage rotor 58 and a second annular region 68 adjacent the second stage rotor 60. The seal ring 62 includes an outer flange 72 and an inner flange 74. The outer flange 72 includes splines (not shown) to prevent rotation and an abradable bearing pad 76 (see FIG. 6) similar to that described heretofore, including the various embodiments of the bearing pad 76. An honeycomb pad 78 is attached to the inner flange 74 for use with knife-edge seal blades 80. The splines disposed in the outer flange 72 are slidably received, in an axial direction, within inner mounting flanges 82 extending below the inner platforms 64. Tabs (not shown), extending out from the outer flange 72, limit the axial travel of the seal ring 62 relative to the inner mounting flanges 82. The pressure difference between the first annular region 66 (at $P_1$) adjacent the first rotor stage 58 and the second annular region 68 (at $P_2$) adjacent the second stage rotor 60 forces the abradable bearing pad 76 of the seal ring 62 into contact with the aft arm 84 of the inner mounting flanges 82 ($P_1 > P_2$).

Referring to FIGS. 1 and 5, in the operation of the engine core gas flow acting on the stator vane segments 22, 61 will cause the stator vane segments 22, 61 to grow thermally, vibrate, and/or displace. The present invention seal rings 24, 26, 62 accommodate growth, vibration, and displacement of the stator vane segments 22, 61 by allowing the individual stator vane segments 22, 61 to abrade the abradable bearing pad 44, 76 attached to the seal ring 24, 26, 62. The seal ring 24, 26, 62 consequently provides fewer and/or smaller leak paths through which cooling air may enter the core gas flow, which in turn minimize the amount of cooling air lost due to undesirable leakage.

Although this invention has been shown and described with respect to the detailed embodiments thereof, it will be understood by those skilled in the art that various changes in form and detail thereof may be made without departing from the spirit and the scope of the invention. For example, depending upon the application it may be desirable to fix a stop 48 to the axial surface 46 of the seal ring 24, 26, 62 and fix the abradable bearing pad 44, 76 to the stop 48. In this embodiment, the stop 48 prevents a stator vane segment 22, 61 from abrading into the body 42 of the seal ring 24, 26, 62.

We claim:

1. A stator vane assembly for a gas turbine engine, comprising:

a plurality of stator vane segments, each said segment having an outer platform, an inner platform, and an airfoil extending between said platforms, said vane segments collectively forming an annular structure; and a seal ring, attached to a non-rotating member within the gas turbine engine, having a body and an abradable bearing pad, said abradable bearing pad extending out from an axial surface of said seal ring, positioned in close proximity to said stator vane segments;

wherein contact and consequent friction between each said stator vane segment and said abradable bearing pad causes said abradable bearing pad to abrade, thereby creating a sealing surface reflective of each said stator vane segment in contact with said abradable bearing pad.

2. A stator vane assembly for a gas turbine engine according to claim 1, wherein said abradable bearing pad is aligned with one of said inner or outer platforms of said stator vane segments.

3. A stator vane assembly for a gas turbine engine according to claim 1, wherein abradable bearing pad is bonded to said axial surface of said seal ring.

4. A stator vane assembly for a gas turbine engine according to claim 3, wherein said abradable bearing pad is aligned with one of said inner or outer platforms of said stator vane segments.

5. A stator vane assembly for a gas turbine engine according to claim 1, wherein seal ring further comprises:

a stop, attached to said axial surface of said seal ring, wherein said stop extends axially out from said axial surface a distance less than said abradable bearing pad extends axially out from said axial surface.

6. A stator vane assembly for a gas turbine engine according to claim 5, wherein said abradable bearing pad is aligned with one of said inner or outer platforms of said stator vane segments.

7. A stator vane assembly for a gas turbine engine according to claim 6, wherein said stop is attached to said axial surface adjacent said abradable bearing pad.

8. A stator vane assembly for a gas turbine engine according to claim 1, wherein said abradable bearing pad is a detachable and replaceable ring, mounted on said body of said seal ring.

9. A stator vane assembly for a gas turbine engine according to claim 8, wherein said abradable bearing pad is aligned with one of said inner or outer platforms of said stator vane segments.

10. A method for sealing a stator vane assembly for a gas turbine engine, comprising the steps of:

providing a stator vane assembly, having a plurality of stator vane segments, each said segment having an outer platform, an inner platform, and an airfoil extending between said platforms, said vane segments collectively forming an annular structure; and providing a seal ring, positioned between said stator vane segments and a static member within the gas turbine engine, said seal ring including a body and an abradable bearing pad extending out from an axial surface of said body;

attaching said seal ring to a non-rotating member within the gas turbine engine, with said abradable bearing pad in close proximity to said stator vane segments; and biasing said abradable bearing pad into contact with said stator vane segments;

abrading said abradable bearing pad with said stator vane segments, thereby creating a sealing surface reflective of each said stator vane segment in contact with said abradable bearing pad.

* * * * *